US006937838B2

(12) United States Patent
Ishii et al.

(10) Patent No.: US 6,937,838 B2
(45) Date of Patent: Aug. 30, 2005

(54) WASTE TONER COLLECTING DEVICE, AND IMAGE FORMING APPARATUS INCLUDING THE WASTE TONER COLLECTING DEVICE

(75) Inventors: Hiroshi Ishii, Yokohama (JP); Yuji Arai, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 29 days.

(21) Appl. No.: 10/660,636

(22) Filed: Sep. 12, 2003

(65) Prior Publication Data

US 2004/0052560 A1 Mar. 18, 2004

(30) Foreign Application Priority Data

Sep. 12, 2002 (JP) ..... 2002-266886

(51) Int. Cl.[7] ..... G03G 21/10
(52) U.S. Cl. ..... 399/358; 399/360
(58) Field of Search ..... 399/358, 359, 399/360, 123, 120, 99, 35

(56) References Cited

U.S. PATENT DOCUMENTS

| | | | | |
|---|---|---|---|---|
| 4,323,306 A | * | 4/1982 | Ito et al. | 399/358 |
| 4,761,674 A | | 8/1988 | Ogura | 399/35 |
| 4,849,791 A | | 7/1989 | Hagihara et al. | 399/360 |
| 5,065,195 A | * | 11/1991 | Haneda et al. | 399/358 X |
| 5,121,168 A | * | 6/1992 | Aoki et al. | 399/359 |
| 5,146,270 A | * | 9/1992 | Matsuo et al. | 399/358 X |
| 5,537,191 A | * | 7/1996 | Aruga et al. | 399/359 X |
| 5,581,342 A | | 12/1996 | Yamauchi | 399/123 |
| 5,617,195 A | * | 4/1997 | Torimaru et al. | 399/358 X |
| 6,085,052 A | * | 7/2000 | Yamane et al. | 399/358 X |
| 6,493,528 B2 | * | 12/2002 | Sameshima et al. | 399/360 X |
| 2003/0219290 A1 | * | 11/2003 | Harumoto et al. | 399/358 |

FOREIGN PATENT DOCUMENTS

| | | |
|---|---|---|
| EP | 0 342 660 | 11/1989 |
| JP | 08-328366 | * 12/1996 |
| JP | 11-003015 | * 1/1999 |
| JP | 11-095519 | 4/1999 |
| JP | 2000-264492 | 9/2000 |
| JP | 2001-265096 | 9/2001 |
| JP | 2001-296712 | * 10/2001 |
| JP | 2002-006574 | * 1/2002 |
| JP | 2002-148884 | * 5/2002 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

A waste toner collecting device includes a container detachably set in an image forming apparatus and a waster toner transport device to transport waste toner in the container. The container has a shape as to fit into a free space of the image forming apparatus. The image forming apparatus also includes an image bearing member, and a cleaning device configured to collect a residual toner remaining on the image bearing member.

42 Claims, 15 Drawing Sheets

WASTE TONER COLLECTING DEVICE, AND IMAGE FORMING APPARATUS INCLUDING THE WASTE TONER COLLECTING DEVICE

BACKGROUND OF THE INVENTION

1. Field of the Invention

The present invention relates to a waste toner collecting device, and more particularly to a waste toner collecting device which collects and contains a waste toner produced by an image forming apparatus, which remains on an image bearing member and which is removed by a cleaner therefrom. In addition, the present invention also relates to an image forming apparatus including the waste toner collecting device.

2. Discussion of the Background

Recently, users of image forming apparatus such as copiers, printers, facsimiles and complex machines thereof perform operations such as change of consumable supplies of the image forming apparatus and maintenance operations that service men have conventionally performed.

Recently, image forming apparatus have been miniaturized and the price thereof is reduced, and the constitutional parts of the image forming apparatus have also been miniaturized as much as possible. In addition, recently users have to replace parts which have lost their functions before expiration of their lives, and a container which is set in an image forming apparatus to contain toner and paper duct remaining on an image bearing member and being removed therefrom by a cleaner, at a regular interval.

In addition, with widespread of personal computers, image forming apparatus are typically set near personal computers. Therefore, it is important to reduce noise generated during image forming operations.

Toner particles (hereinafter sometimes referred to as a waste toner) which are transferred to an image bearing member but are not transferred to a receiving material are collected and contained in a container. In order to reuse the waste toner, the image forming apparatus have to include passages through which the waste toner is collected and driving mechanism which feeds the waste toner, resulting in jumboization of the image forming apparatus.

In addition, the waste toner includes paper dust released from transfer paper sheets, but it is difficult to separate the waste toner from paper dust. Further, in full color image forming apparatus using three or four color toners, the amount of the waste toners is large, and thereby a large container has to be set in the image forming apparatus, resulting in jumboization and complication of the image forming apparatus.

Therefore, a technique in that a relatively small container is set in an image forming apparatus and the container is replaced with an empty container when the container is fully filled with a waste toner is typically used. In this case, it is a problem to be solved how to efficiently collect the waste toner (i.e., how to fully fill the container with the waste toner) in order to reduce the container changing frequency.

In general, operations of collecting a waste toner are performed by falling the waste toner into a container from above. Whether or not the container is fully filled with the waste toner is detected with a chock-full detector arranged on an upper portion of the container. Therefore it is important to evenly fill the container with the waste toner without causing mal-distribution of the waste toner in the container.

In attempting to contain a waste toner evenly, a technique in that a container is shaken and a technique in that a piled waste toner is leveled are well known.

The former technique has the following drawbacks:

(1) noise is generated during the shaking operation;

(2) a shaking mechanism has to be provided in the image forming apparatus;

(3) since the containers shaken, a chock-full detector has to be provided in the container which is disposed of when the container is fully filled with a waste toner, resulting in increase of cost of the container; and (4) an operation such that a connector is connected to a chock-full detector is necessary when the container used is replaced.

The latter technique has the following drawbacks:

(1) a leveling member is provided without taking into consideration of the shape of the container used, and thereby the waste toner piled is not fully leveled if the container has a complex shape;

(2) the waste toner tends to firmly fix in the container when the waste toner is insufficiently leveled; and (3) a problem in that the waste toner overflows the container tends to occur when the waste toner is insufficiently leveled.

Namely, with miniaturization and sophistication of image forming apparatus, the free space in the image forming apparatus is reduced and has a complex form. Therefore, a waste toner container tends to have a complex form because of being set in such a free space. Therefore, the waste container has a portion in which the waste toner is mainly deposited.

Because of these reasons, a need exists for a waste toner collecting device which can prevent mal-distribution of a waste toner in a container, i.e., which need not be frequently replaced with an empty container, even when the container has such a special form as to fit into a free space of an image forming apparatus.

SUMMARY OF THE INVENTION

Accordingly, an object of the present invention is to provide a waste toner collecting device which can be set in a free space of an image forming apparatus and need not be frequently replaced with an empty container by preventing occurrence of mal-distribution of a waste toner in a container.

Another object of the present invention is to provide an image forming apparatus which can perform image forming operations without frequently changing a waste toner container and in which the waste toner container can be easily replaced with a new container when the container is fully filled with waste toner.

Briefly these objects and other objects of the present invention as hereinafter will become more readily apparent can be attained by a waste toner collecting device including a container which can be detachably set in an image forming apparatus and contains therein waste toner produced in the image forming apparatus and which has such a shape as to fit in the image forming apparatus; and a waste toner transporting device which transports the waste toner in the container.

It is preferable that one of surfaces of the container is opposed to a surface of a member of the image forming apparatus (i.e., one of the surfaces of the container has a shape corresponding to a surface of a member).

It is preferable that the member is a cleaning unit which is slantingly arranged and the surface of the container facing the cleaning unit is slanted in the same direction as that of the cleaning unit.

It is preferable that the container includes one or more openings which are connected with the cleaning unit via at least one waste toner feeding passage of the image forming apparatus, wherein at least one of the openings is located at a highest position of the container.

When plural openings are formed, it is preferable that the openings are arranged at regular intervals. The plural openings are preferably arranged on the slanted surface or a side surface of the container. It is preferable that the area of the openings is greater than that of the waste toner feeding passage.

It is preferable that the waste toner transport device includes a waste toner transporter provided in the container and a driving device configured to drive the toner transporter. It is preferable that the waste toner transporter is configured to transport the waste toner in a direction such that the waste toner is distanced from the one or more openings. The waste toner in the container is preferably transported by the waste toner transporter so as to move from a potion of the container having a shortest height to a portion having a longest height. It is preferable to arrange plural waste toner transporters in the container to effectively transport the waste toner. The waste toner transporter preferably includes at least one of a screw and a belt. The waste toner transporter is preferably provided under the openings. It is preferable that toner transporting capacity of the waste toner transporter is different in each portion thereof in such a manner that the shorter the height of a portion of the container corresponding to a portion of the waste toner transporter, the higher toner transporting capacity the portion of the waste toner transporter has.

The driving device preferably includes a driving motor and a drive force transmitting device configured to transmit the driving force of the motor to the waste toner transporter. The drive force transmitting device preferably has a spur gear (or a bevel gear) arranged on an end of the transporter and another gear configured to transmit the driving force of the motor to the spur gear. The drive transmitting device having such a configuration has better operation ability than drive force transmitting devices using a belt and a pulley.

The container has a support member such as legs on a bottom surface thereof such that the container is securely set horizontally in the image forming apparatus. The support member preferably supports the container at three or more points.

The container may include a waste toner containing portion therein which does not have a slanted surface. By providing such a toner containing portion, a large amount of waste toner can be contained.

In another aspect of the present invention, an image forming apparatus is provided which includes an image bearing member, a cleaning device configured to collect a residual toner remaining on the image bearing member and any one of the above-mentioned waste toner collecting devices which contain the collected toner therein.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention will be explained referring to drawings.

Figure 1:
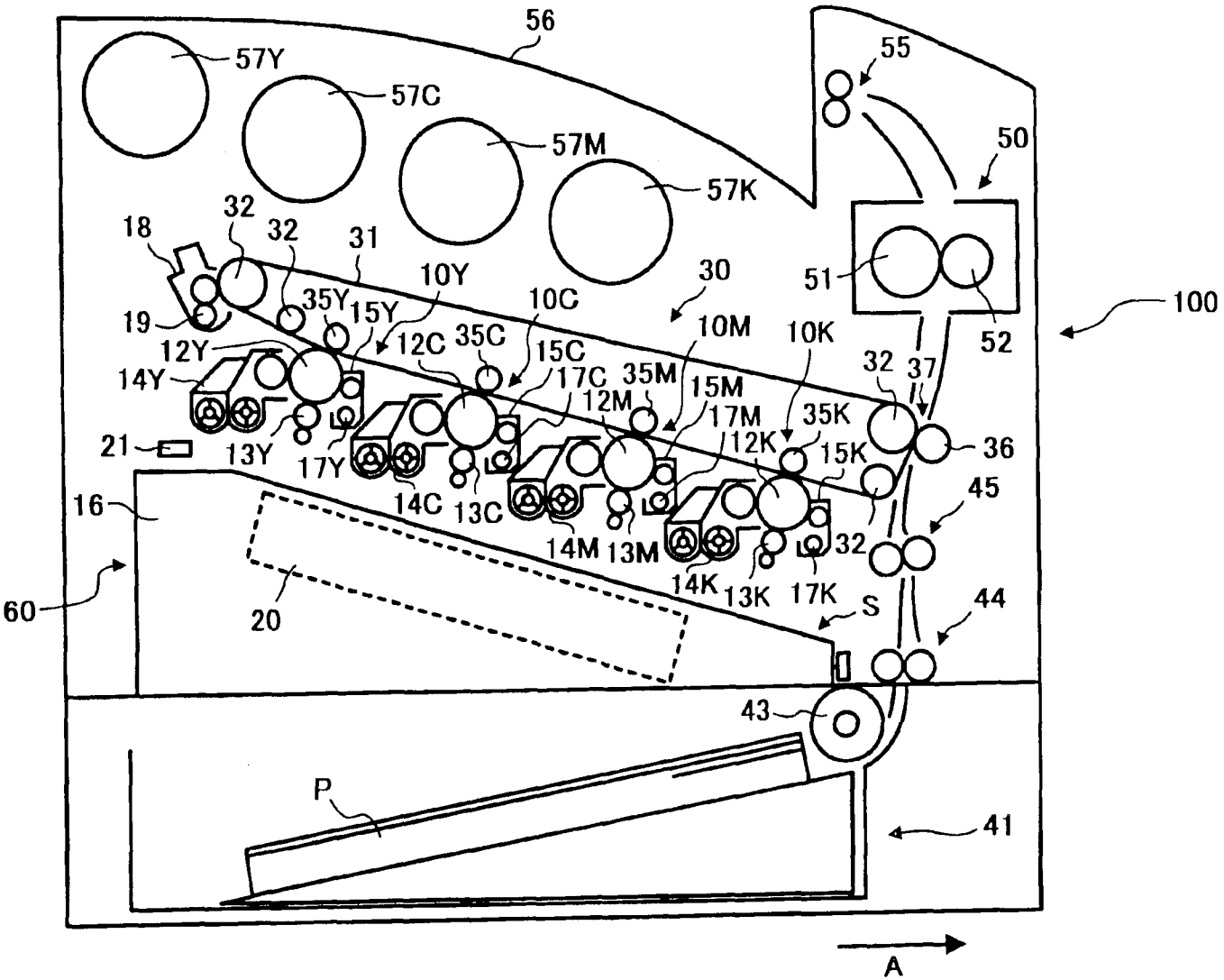
FIG. 1 is a schematic view illustrating the main portion of an embodiment of the image forming apparatus of the present invention.

FIG. 1 is a schematic view illustrating a color printer which is an embodiment of the image forming apparatus of the present invention. Referring to FIG. 1, the color printer has a main body 100 and a paper supplying cassette 41 which is located below the main body 100 and which contains and feeds sheets of a receiving paper P.

The paper supplying cassette 41 can be attached to and detached from the image forming apparatus in the right and left direction in FIG. 1. The receiving paper P in the paper supplying cassette 41 is fed into the main body 100 by a paper supplying roller 43 and a pair of feeding rollers 44. A pair of registration rollers 45 are arranged at a position in a paper feeding passage between the pair of feeding rollers 44 and a second transfer portion 37, to timely feed the receiving paper P toward the second transfer portion 37.

The main body 100 includes image forming cartridges 10Y, 10C, 10M and 10K, which produce color toner images of yellow, cyan, magenta and black, respectively; an optical unit 20 serving as an image irradiator and irradiating photoreceptors 12Y, 12C, 12M and 12K with imagewise laser light; an intermediate transfer unit 30 including an intermediate transfer belt 31 which serves as an intermediate transfer medium and on which color toner images formed on the photoreceptors by the image forming cartridges 10Y, 10C, 10M and 10K are transferred; the second transfer portion 37 at which the color toner images formed on the intermediate transfer belt 31 are second transferred onto the receiving paper P; a fixing unit 50 which serves as a fixing device and which fixes the color toner images on the receiving paper P; and a pair of discharging rollers 55 which discharge the receiving paper P, on which the color toner images are fixed, from the main body 100.

The second transfer portion 37 is a nip portion at which the intermediate transfer belt 31 contacts a transfer roller 36 which is arranged so as to face the intermediate transfer belt 31.

The image forming cartridges 10Y, 10C, 10M and 10K have the same configuration, and respectively include the photoreceptor drums 12Y, 12C, 12M and 12K; chargers 13Y, 13C, 13M and 13K which charge the respective photoreceptor drums; cleaners 15Y, 15C, 15M and 15K which remove toner particles (i.e., a waste toner) remaining on the respective photoreceptor drums without being transferred to the intermediate transfer belt 31; etc.

Developing devices 14Y, 14C, 14M and 14K, which develop electrostatic latent images formed on the respective photoreceptor drums, are arranged so as to be connected with the image forming cartridges 10Y, 10C, 10M and 10K. The cleaners 15Y, 15C, 15M and 15K respectively include feeding screws 17Y, 17C, 17M and 17K, which feed waste toners to respective feeding pipes (61Y, 61C, 61M and 61K), which are explained later in detail. Numerals 57Y, 57C, 57M and 57K represent toner containers which contain respective color toners and from which the color toners are supplied to the respective developing devices 14Y, 14C, 14M and 14K.

The intermediate transfer unit 30 includes the intermediate transfer belt 31; four rollers 32 which rotatably support the intermediate transfer belt 31; first transfer rollers 35Y, 35C, 35M and 35K which transfer the color toner images formed on the photoreceptors onto the intermediate transfer belt 31; and the second transfer roller 36 which transfer the toner images formed on the intermediate transfer belt 31 to the receiving paper P. The fixing unit 50 includes a fixing roller 51 and a pressure roller 52 for fixing the toner images on the receiving paper P upon application of heat and pressure thereto.

Then the image forming process will be explained in detail. For example, when a black image is formed, the photoreceptor drum 12K is uniformly charged with the charger 13*k*, followed by irradiation of imagewise laser light emitted from the optical unit 20, resulting in formation of an electrostatic latent image on the photoreceptor drum 12K. The electrostatic latent image is developed by the developing device 14K using a black toner. The toner image formed on the photoreceptor 12K is transferred onto the intermediate transfer belt 31 by the first transfer roller 35K. The surface of the photoreceptor drum 12K is then cleaned by the cleaner 15K to be ready for the next image forming operations.

The receiving paper P fed into the main body 100 by the paper supplying roller 43 and the feeding roller 44 receives the toner image formed on the intermediate transfer belt 31 at the second transfer portion 37. The receiving paper P having the toner image thereon is then fed through the fixing unit 50 so that the toner image is fixed. The receiving paper P with the toner image is discharged to a discharge tray 56 by the pair of discharging rollers 55.

The toner containers 57Y, 57C, 57M and 57K, the intermediate transfer belt 31, and the image forming cartridges 10Y, 10C, 10M and 10K, are arranged so as to be slanted in the same direction relative to the main body 100 to shorten the total length of the main body 100, i.e., to miniaturize the main body 100. In particular, in the present embodiment the image forming cartridge 10K is arranged at a position closer to the second transfer portion 37, i.e., the image forming cartridges 10Y, 10C, 10M and 10K are slanted such that the image forming cartridge 10*k* is located below the image forming cartridges 10Y, 10C and 10M. The black image forming cartridge 10K is arranged at a position closer to the second transfer portion 37 to produce a black toner image at a time less than those of the other toner images because black toner images are formed more frequently than the other toner images.

By thus slantingly arranging the devices in the main body 100, a free space S is formed between the image forming cartridges 10Y, 10C, 10M and 10K and the paper supplying cassette 41.

This image forming apparatus includes a waste toner collecting device 60 which collects waste toners produced by cleaning operations of the cleaners 15Y, 15C, 15M and 15K to contain the waste toners in a waste toner container 16 (hereinafter referred to as a container).

Figure 4:
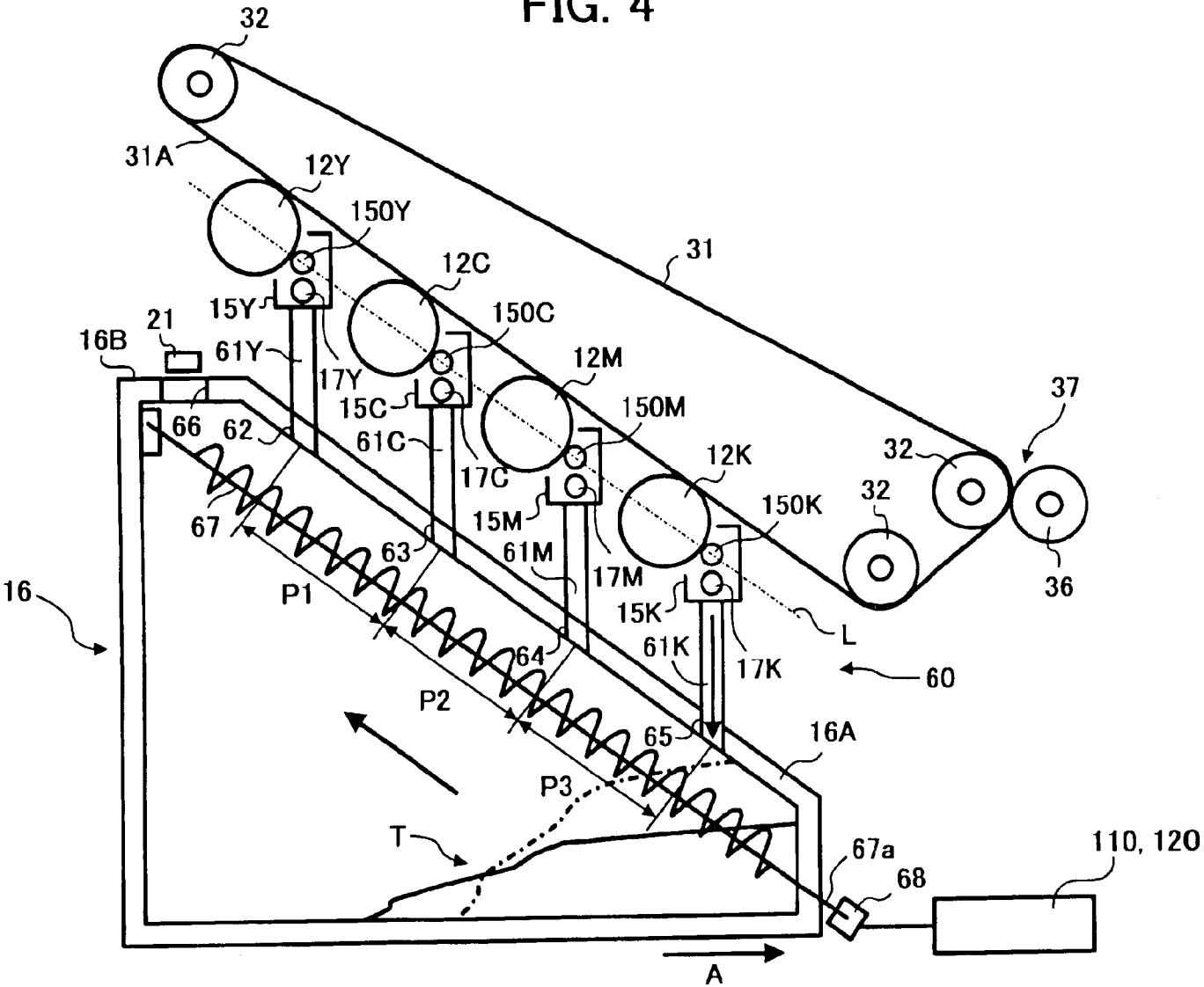
FIG. 4 is a schematic view illustrating the main portion of the image forming apparatus and an embodiment of the waste toner collecting device of the present invention.

As illustrated in FIG. 4, the waste toner collecting device 60 includes the container 16, feeding pipes 61Y, 61C, 61M and 61K, which serve as waste toner feeding passages and which are connected with the cleaners 15Y, 15C, 15M and 15K, and screws (not shown) which are arranged in the feeding pipes 61Y, 61C, 61M and 61K and which are driven by a driving motor (not shown).

Referring to FIG. 1, the container 16 is detachably set in the main body 100 to be replaced with new one when desired. When the container 16 is fully filled with waste toners, a sensor 21 provided on the main body 100 activates.

When color images are formed in the image forming apparatus, image forming operations similar to the black image forming operation mentioned above are performed in the image forming cartridges 10Y, 10C and 10M, resulting in formation of yellow, cyan and magenta toner images. The thus prepared color toner images are sequentially transferred onto proper positions of the intermediate transfer belt 31 so as to be overlaid thereon. The thus prepared color toner images are transferred onto the receiving paper P, which is supplied from the paper supplying cassette 41 and fed by the paper supplying roller 43 and the pair of registration rollers 44, at the second transfer portion 37 by the second transfer roller 36.

The receiving paper P having the color toner images thereon is fed to the fixing device 50 so that the color toner images are fixed on the receiving paper P at the nip between the fixing roller 51 and the pressure roller 52. The receiving paper P having a fixed full color image thereon is then discharged on the discharge tray 56 by the pair of discharge rollers 55 which are located on the downstream side from the fixing device 50 relative to the paper feeding direction.

Similarly to the case of the photoreceptor drum 12K, toner particles remaining on the intermediate transfer belt 31 without being transferred onto the receiving paper P are collected by a belt cleaner 18. The collected waste toners are fed to the container 16 through a feeding screw 19 and a waste toner feeding passage (not shown).

Figure 2:
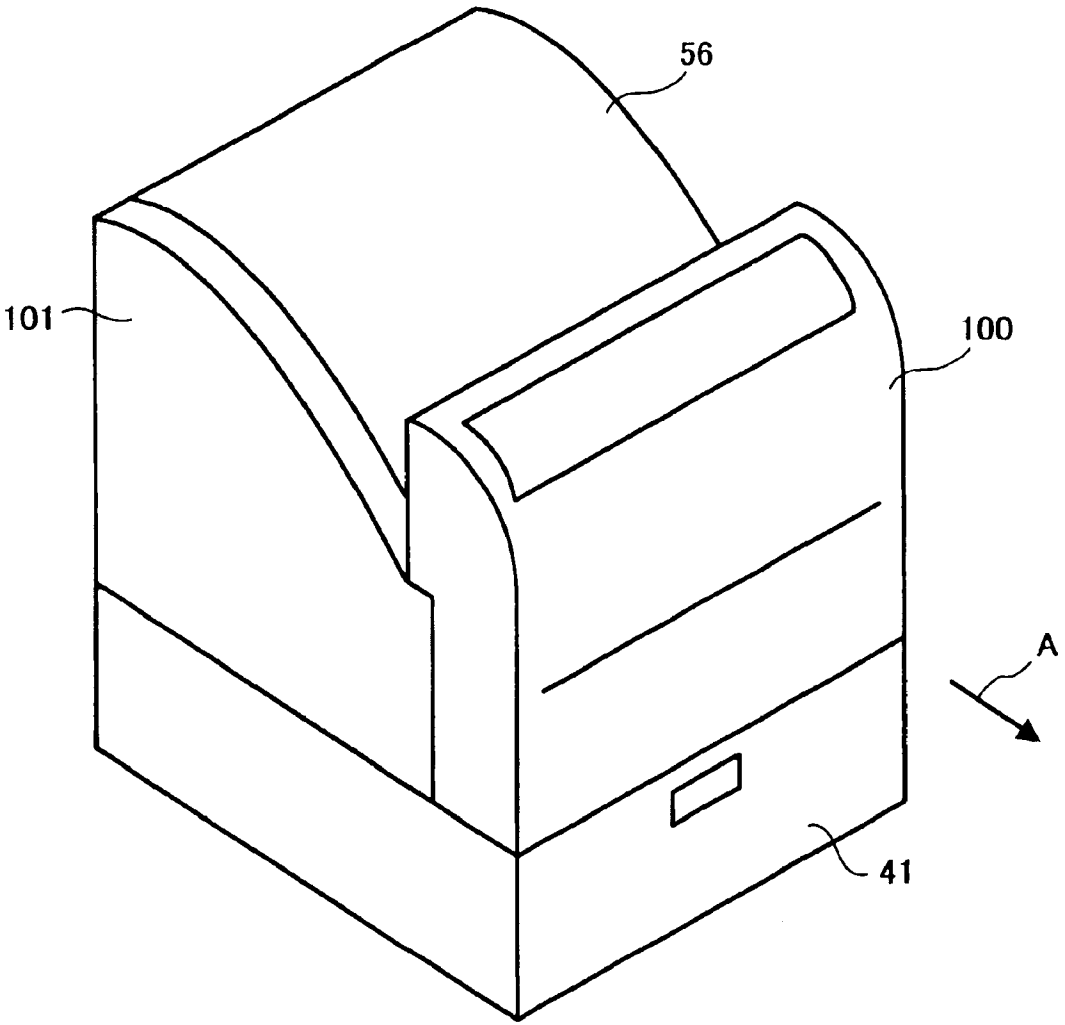
FIG. 2 is a perspective view illustrating the image forming apparatus illustrated in FIG. 1.
Figure 3:
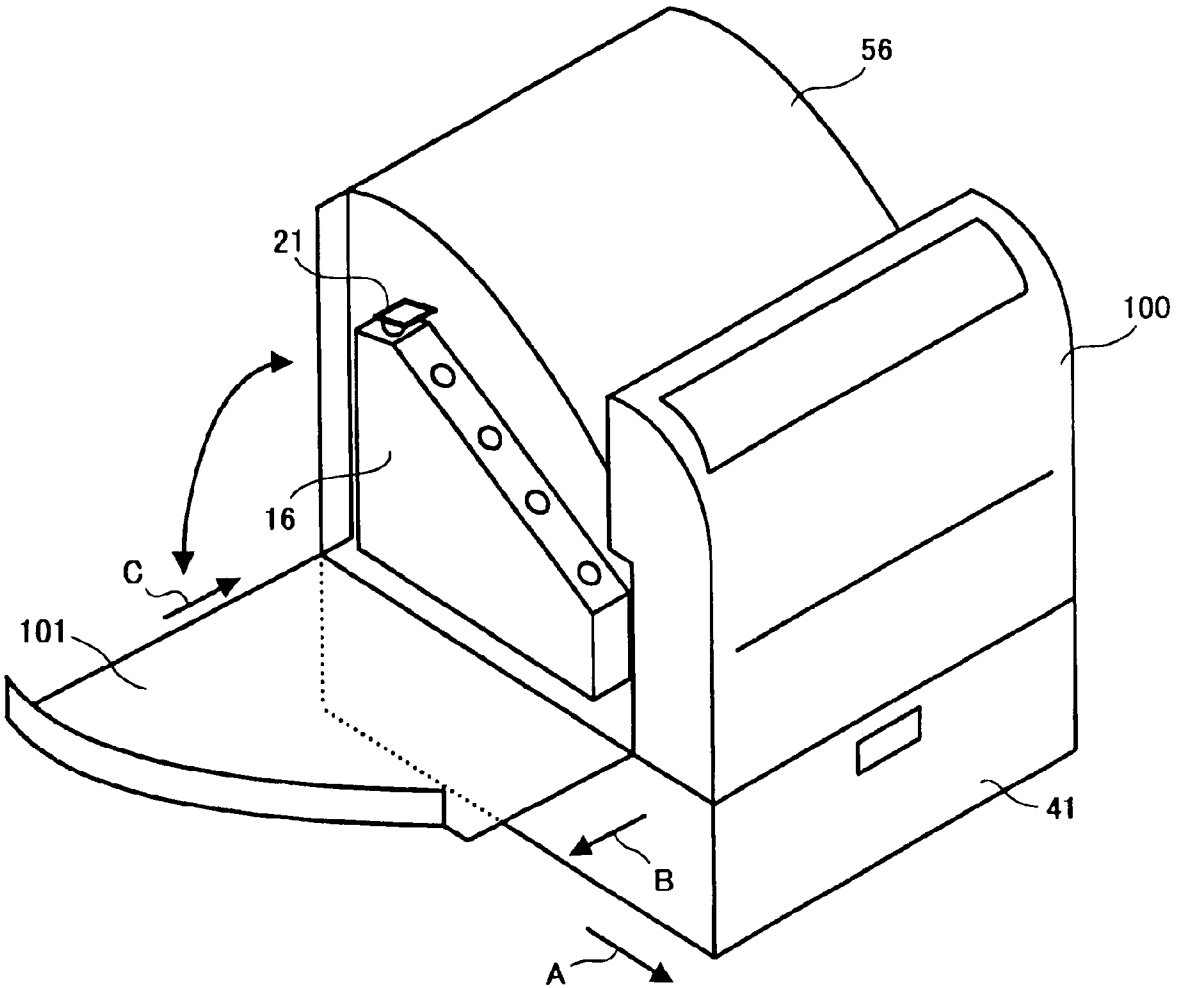
FIG. 3 is a perspective view illustrating the image forming apparatus illustrated in FIG. 1 being in a state in which the side cover thereof is opened.

FIG. 2 is a perspective view illustrating the image forming apparatus illustrated in FIG. 1. Provided that the side of the image forming apparatus from which the paper supplying cassette 41 is pulled in a direction indicated by an arrow A is a front side of the image forming apparatus, the left side of the main body 100 has a side cover 101 which is supported by the main body 100 so as to be opened or shut as illustrated in FIG. 3.

The container 16 is arranged so as to be detached from the main body 100 when the side cover 101 is opened. The container 16 is set from the outside to the main body 100 in a direction indicated by an arrow C. By pulling the container 16 in a direction indicated by an arrow B, the container 16 can be detached from the main body 100.

The sensor 21 is arranged on the main body 100 so as to be located over the container 16 when the container 16 is set in the main body 100.

Namely, when the container 16 is replaced with new one, the sensor 21 is not replaced, resulting in cost saving of the container 16.

Referring to FIG. 4, the container 16 is located below the cleaners 15Y, 15C, 15M and 15K. The container 16 has a rectangular form and a slanted surface 16A which is located on an upper portion thereof so as to face the cleaners 15Y, 15C, 15M and 15K. Namely, the height and volume of the container 16 are different in each portion of the container in the direction A. The slanted surface 16A has substantially the same angle of inclination as that of a line L which is obtained by connecting cleaners 150Y, 150C, 150M and 150 K (i.e., which is obtained by connecting the photoreceptor drums 12Y, 12C, 12M and 12K).

In the present embodiment, the intermediate transfer belt 31 is arranged such that a side 31A of the intermediate transfer belt 31, which faces the photoreceptor drums 12Y, 12C, 12M and 12 K, is substantially parallel to the line L. By arranging the slanted surface 16A so as to be parallel to the line L, the interval between the slanted surface 16A and the cleaners 150Y, 150C, 150M and 150K can be maintained to be uniform, and thereby the same pipe can be used for the feeding pipes 61Y, 61C, 61M and 61K, resulting in reduction of part costs. In addition, intervals P1, P2 and P3 between the feeding pipes 61Y, 61C, 61M and 61K are the same.

The container 16 has openings 62, 63, 64 and 65 which are connected with one end of the respective feeding pipes 61Y, 61C, 61M and 61K. On an uppermost surface 16B of the container 16, an opening 66 through which the sensor 21 can detect the volume of the waste toner contained in the container 16. The opening 66 may be connected with the feeding screw 19 (illustrated in FIG. 1) using a toner passage.

In the container 16, a screw member 67, which transports a waste toner T collected and contained in the container 16, is provided at a location below the openings 62, 63, 64 and 65 so as to face the openings. Both ends of the screw member 67 are rotatably supported by the container 16, and a lower end 67*a* extends from the container 16. A drive force transmitting member 68 is arranged so as to be unitedly rotated with the screw member 67. The screw member 67 is set so as to transfer the waste toner in the container 16 in such a direction that the waste toner is distanced from the openings when the screw member 67 is rotated in a direction.

In the present embodiment, the screw member 67 is arranged so as to extend from the lower portion 67*a* toward the uppermost surface 16B to transport the waste toner T from the lower portion of the container 16 toward the higher portion thereof when a driving force is transmitted to the screw member 67.

Then the operations of the waste toner collecting device 60 will be explained. Referring to FIG. 4, the waste toners collected by the cleaners 15Y, 15C, 15M and 15*k* are fed to the container 16 by the feeding screws 17Y, 17C, 17M and 17K through the feeding pipes 61Y, 61C, 61M and 61K. Thus, the waste toners are contained in the container 16.

Since the height of the container 16 changes in the direction A, the capacity of each portion of the container 16 to contain the waste toner changes depending on the location of the portion. Provided that the same quantity of waste toner is collected from each feeding pipe, the portion of the container 16 below the opening 65 is fully filled with the waste toner relatively quickly compared to the portion below the opening 62. In this case, when the volume of the waste toner is detected by the sensor 21 which is located at a position close to the opening 62, a problem in that the waste toner overflows the container through the opening 65 or the feeding pipe 61K is clogged with the waste toner tends to occur.

In the present embodiment, since the screw member 67, which is rotated by receiving a driving force, is provided in the container 16, the waste toner deposited at the portion of the container having a short height is transported toward the portion having a long height, i.e., a piled waste toner is corrupted. Therefore, even when the container 16 has such a special form as illustrated, occurrence of problems such that the waste toner overflows the container through the opening 65 or the feeding pipe 61K is clogged with the waste toner and the piled waste toner is firmly fixed in the container can be prevented. Thus, it is possible to make good use of the internal space of the container 16, and thereby the replace cycle of the container 16 can be extended, resulting in reduction of maintenance time and costs.

In addition, the container 16 includes the openings 62, 63, 64 and 65 which are connected with the respective feeding pipes 61Y, 61C, 61M and 61K, and therefore collection of the waste toner can be efficiently performed.

Figure 5:
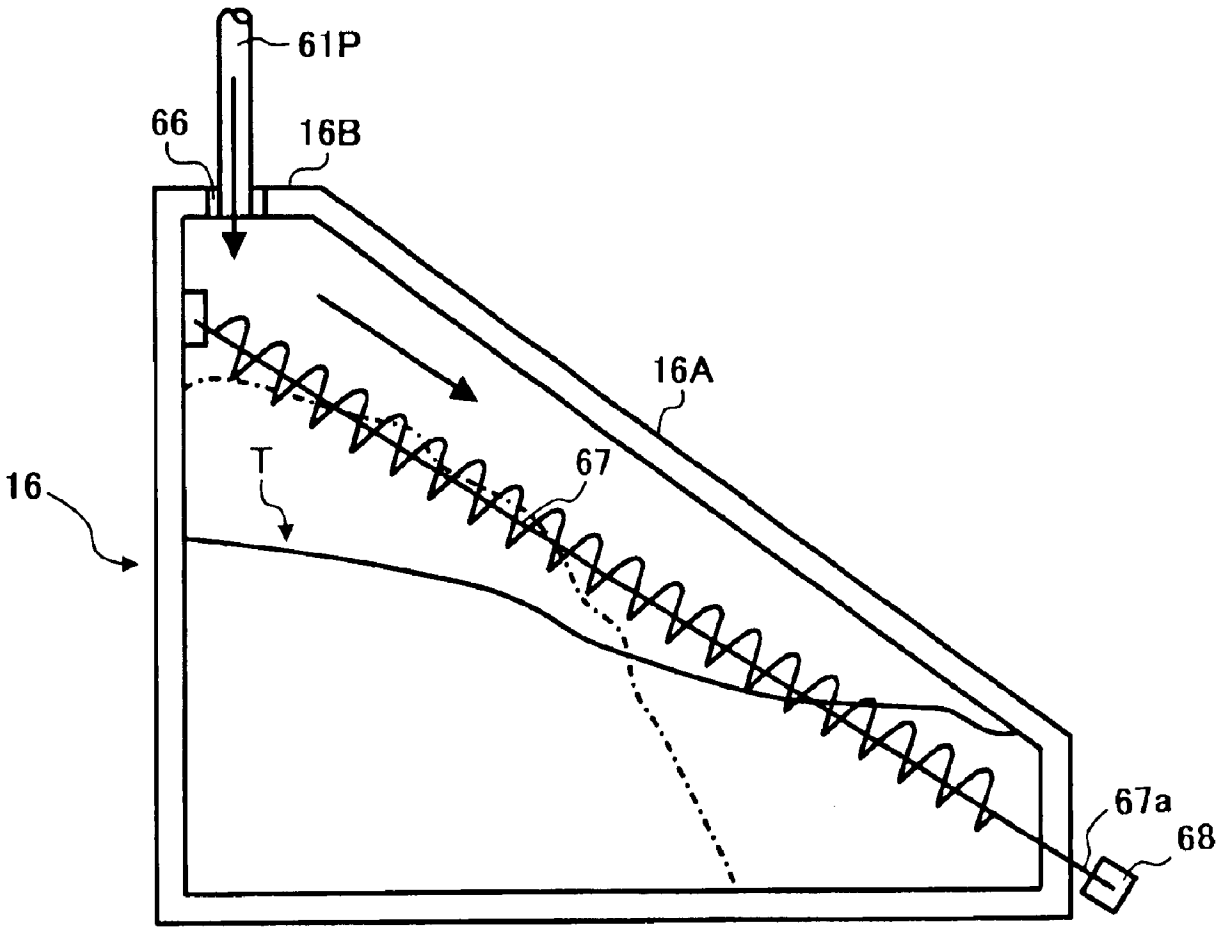
FIG. 5 is a cross sectional view illustrating the inside configuration of another embodiment of the waste toner collecting container for use in the present invention including an opening at a highest position of the container.

FIG. 5 illustrates another embodiment of the container 16 in which only the opening 66 is provided on the uppermost surface 16B thereof. By forming the opening 66 at the uppermost surface 16B, the waste toner is at first contained on the portion having a long height. Therefore, this embodiment has an advantage such that the sensing result of the sensor 21 represents almost accurately the volume of the waste toner contained in the container 16. In this case, since the waste toner is mainly piled on a portion below the opening 66, the screw member 67 is preferably arranged so as to transport the waste toner in a direction such that the waste toner is distanced from the opening 66 (i.e., in a direction from the side of the opening 66 toward the end 67*a* of the screw member 67). Namely, the screw is rotated in a direction opposite that in the case illustrated in FIG. 4.

In this embodiment in which the container 16 has only the opening 66, the end portions of the feeding pipes 61Y, 61C, 61M and 61K illustrated in FIG. 4 may be connected with each other to be connected with the opening 66. Alternatively, as illustrated in FIG. 5, the waste toners produced by the cleaners 15Y, 15C, 15M and 15K collected through the feeding pipe 61P.

Figure 6:
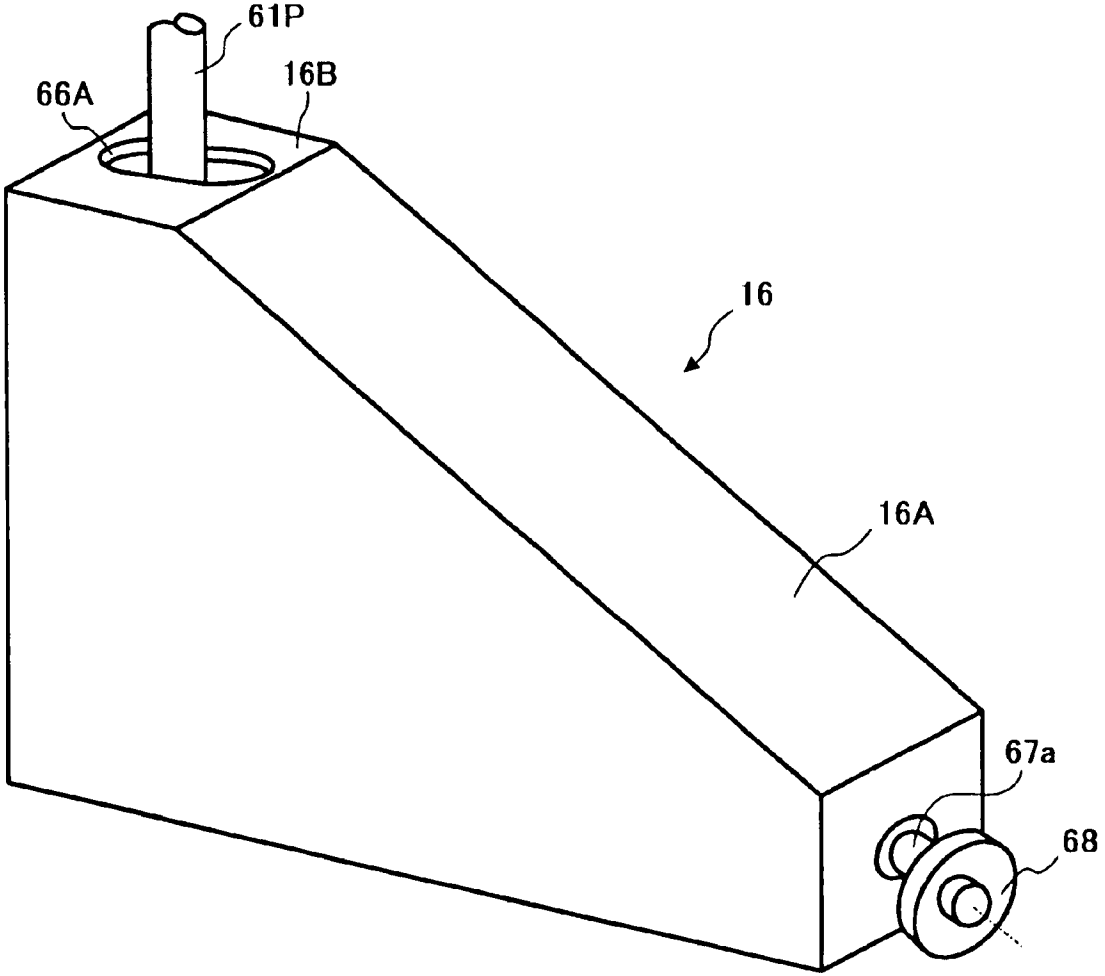
FIG. 6 is a perspective view illustrating yet another embodiment of the waste toner collecting container for use in the present invention having an opening whose area is larger than that of the cross section of the waste toner feeding passage.

Since the container 16 has to be detachably set in the main body 100, it is preferable to form an opening 66A having an area greater than that of the cross section of the feeding pipe 61P as illustrated in FIG. 6. By forming such an opening 66, the container changing operation and a pipe setting operation can be easily performed. In this case, it is preferable to provide a member made of a sponge between the pipe 61P and the opening 66A in order to prevent occurrence of toner scattering and toner leakage. Alternatively, a method in which the opening 66A may be sealed with a thin film before usage, and the pipe 61P is inserted into the opening 66A while braking the thin film when the container 16 is set in the main body 100. Needless to say, the openings 62 to 65 can also have the same configuration as that mentioned above.

Figure 7:
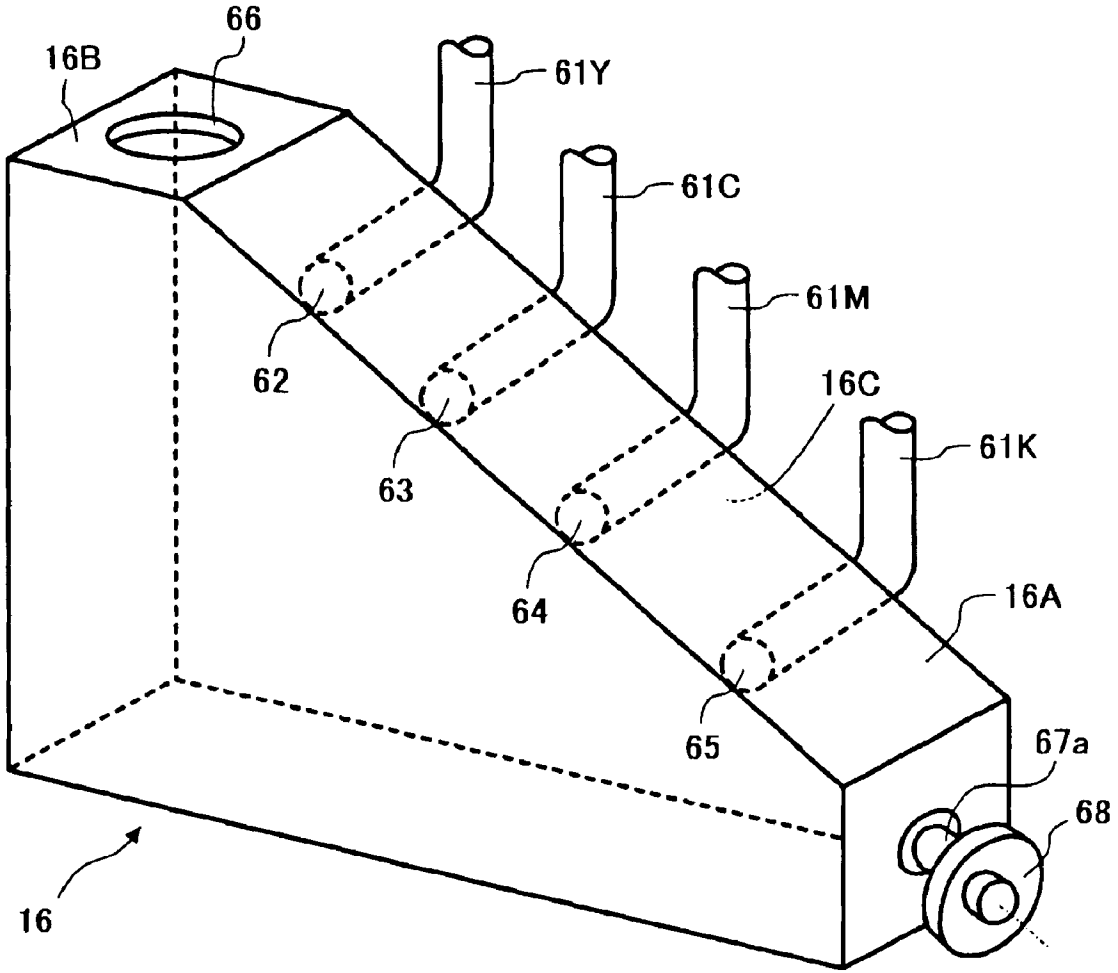
FIG. 7 is a perspective view illustrating yet another embodiment of the waste toner collecting container for use in the present invention having openings at a side surface thereof.

As illustrated in FIG. 7, the feeding pipes 61Y, 61C, 61M and 61K can be arranged so as to be located below the slanted surface 16A through a side surface 16C of the container 16. In this case, the openings 62 to 65 are located below the slanted surface 16A or on the side surface 16C.

Figure 8:
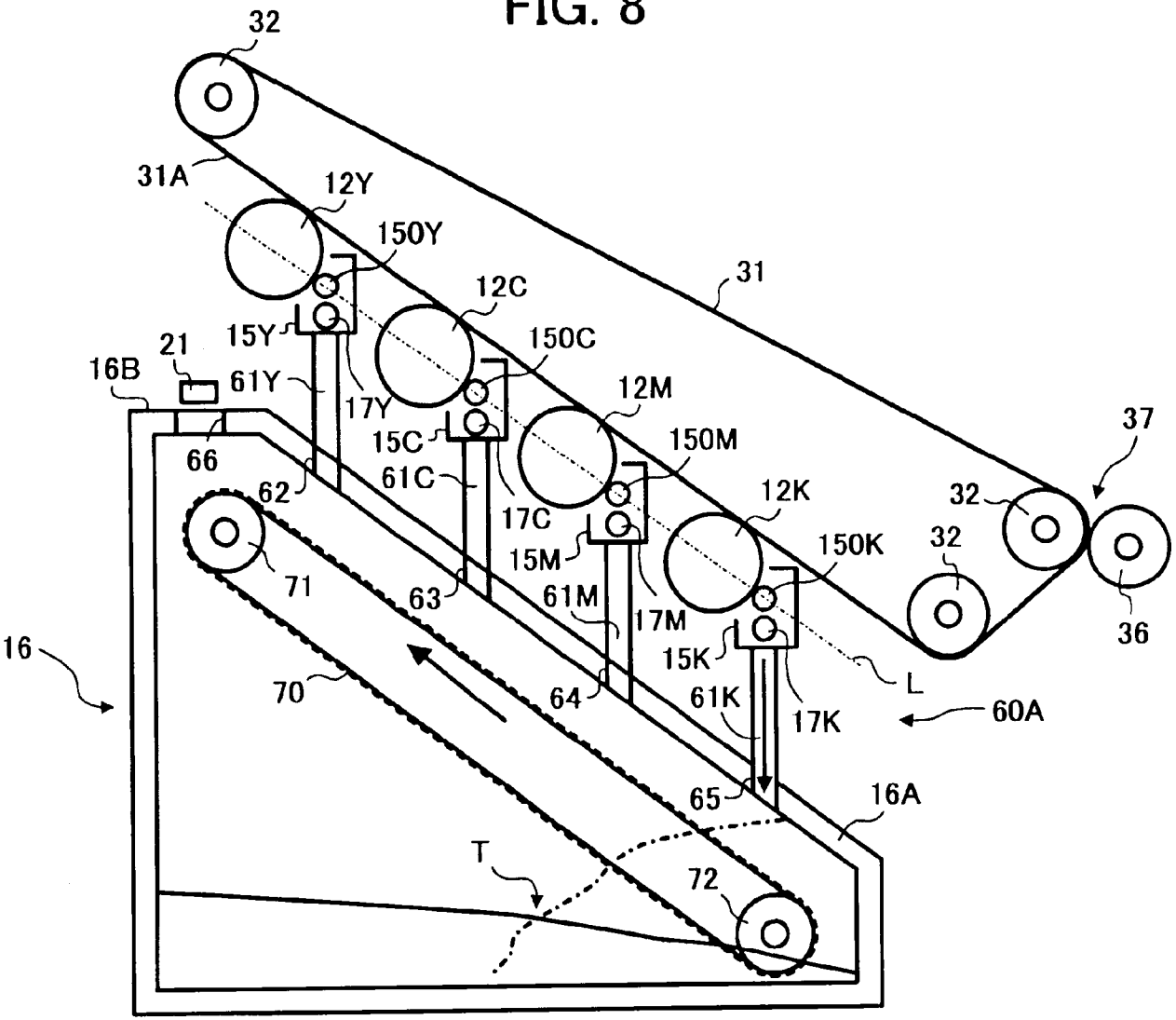
FIG. 8 is a cross section of another embodiment of the waste toner collecting device of the present invention using a belt as a toner feeder.

FIG. 8 illustrates another embodiment of the waste toner collecting device 60A using a belt member 70 as the waste toner transporter. The belt member 70 is rotatably stretched by pulleys 71 and 72 which are provided in the container 16. Plural steps are formed on the belt member 70 to easily transport the collected waste toner T. In this embodiment, the pulley 71 is provided at a position near the opening 66 and the pulley 72 is provided at a position below the opening 65. Thus, the belt member 70 is located so as to be parallel to the slanted surface 16A. The pulley 72 is connected with driving means (not shown) and receives a driving force therefrom such that the belt member 70 is rotated in the counterclockwise direction in FIG. 8.

Even in this embodiment using the belt member 70, the waste toner piled on a portion of the container having a short height is fed by the belt member 70 toward a portion having a long height, resulting in corruption of the waste toner piled on the portion having a short height. Therefore, even when the container 16 has a special form, occurrence of problems such that the waste toner leaks form the opening 65 or the feeding pipe 61K is clogged with the waste toner and the piled waste toner is firmly fixed in the container can be prevented. Thus it is possible to make good use of the internal space of the container 16, and thereby the replace cycle of the container 16 can be extended, resulting in reduction of maintenance time and costs.

Figure 9:
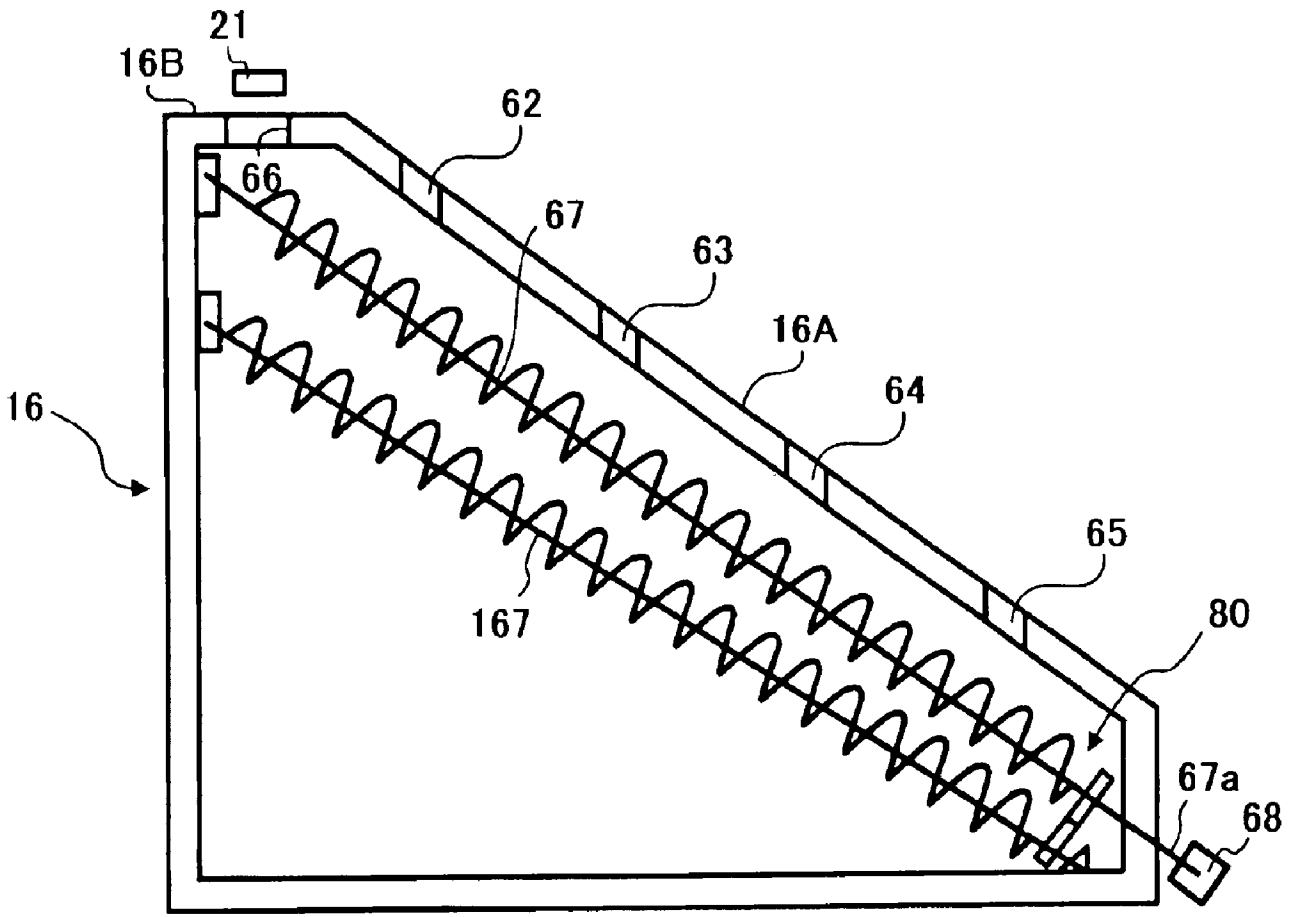
FIG. 9 is a cross sectional view of yet another embodiment of the waste toner collecting device of the present invention including plural waste toner transporters.

FIG. 9 illustrates another embodiment of the container 16 in which plural waste toner transporters, i.e., screws 67 and 167, are provided. The constitution of the container 16 itself is the same as that of the container 16 illustrated in FIG. 4. The screw 167 has the same constitution as that of the screw 67. The screws 67 and 167 are connected with each other using plural gears 80 so as to rotate in the same direction.

By providing the plural screws 67 and 167 in the container 16, the waste toner piled on a portion of the container having a short height can be transferred to a portion having a long height more efficiently. Therefore, even when the container 16 has a special form, occurrence of problems such that the waste toner leaks from the opening 65 or the feeding pipe 61K is clogged with the waste toner and the piled waste toner is firmly fixed in the container can be prevented. Thus, it is possible to make good use of the internal space of the container, and thereby the replace cycle of the container 16 can be extended, resulting in reduction of maintenance time and costs.

In this embodiment, two screws 67 and 167 are provided above and below as the waste toner transferee. However, other constitutions such that plural belt members are provided in the axis direction of the pulleys 71 and 72 can also be adopted.

Figure 10:
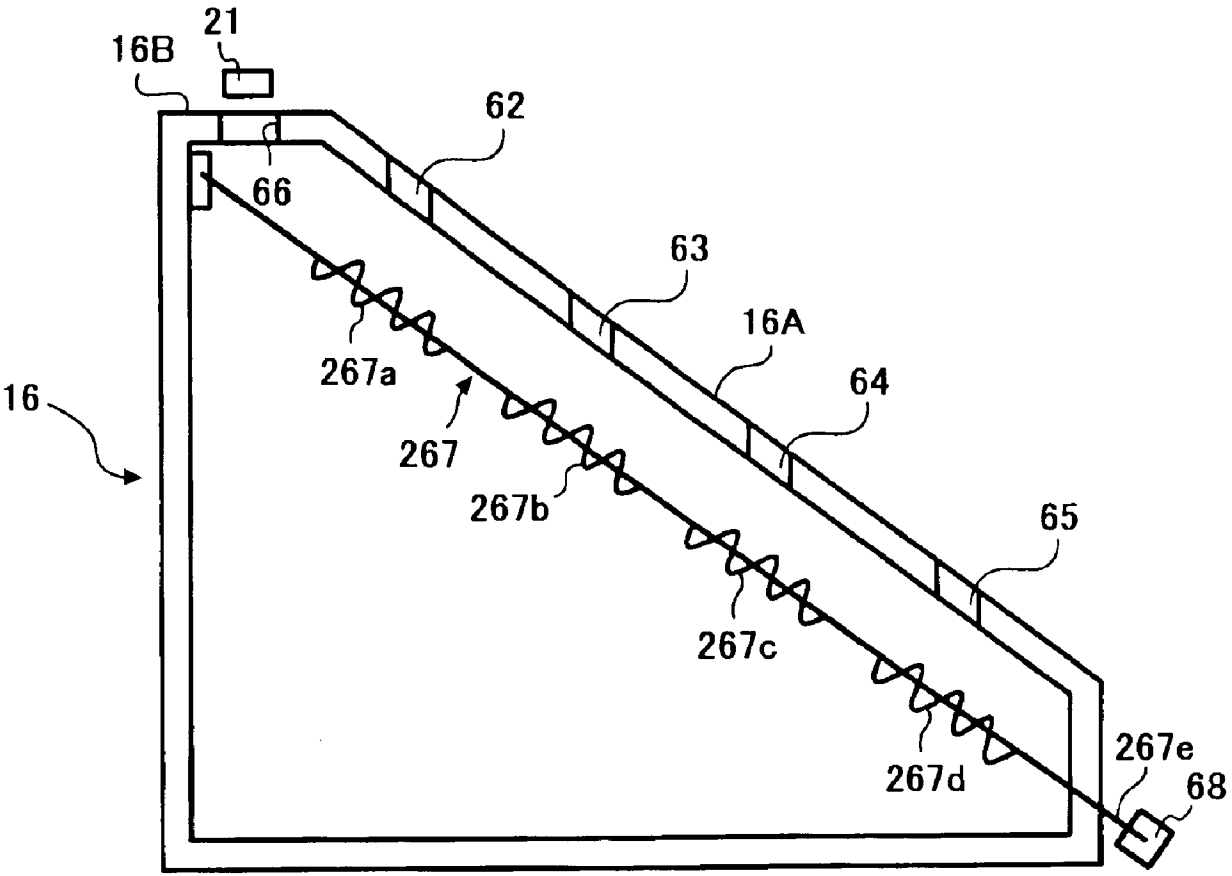
FIG. 10 is a cross sectional view of yet another embodiment of the waste toner collecting device of the present invention including plural waste toner transport portions located at positions corresponding to plural openings.

FIG. 10 illustrates another embodiment of the container 16 in which screws 267*a*, 267*b*, 267*c* and 267*d* are partially formed on portions of a screw member 267 so as to be located below the openings 62, 63, 64 and 65, respectively. The screw member 267 is rotatably supported by the container 16, and a lower end 267*e* of the screw member 267 extends from the container 16. On the end 267*e*, a drive force transmitting member 68 is provided so as to be rotated together with the screw member 267. Namely, by transmitting a driving force to the drive force transmitting member 68, the screw member 267 is rotated.

The waste toner T is typically piled like mountains on the portions of the container 16 below the openings. By rotating the screw member 267, the screws 267*a*–267*d* rotate and thereby the piled waste toner T is corrupted and the waste toner contained in a portion having a short height is transferred toward a portion having a long height. Therefore, even when the container 16 has a special form, occurrence of problems such that the waste toner leaks from the opening 65 or the feeding pipe 61K is clogged with the waste toner and the piled waste toner is firmly fixed in the container can be prevented. Thus, it is possible to make good use of the internal space of the container, and thereby the replace cycle of the container 16 can be extended, resulting in reduction of maintenance time and costs.

Figure 11:
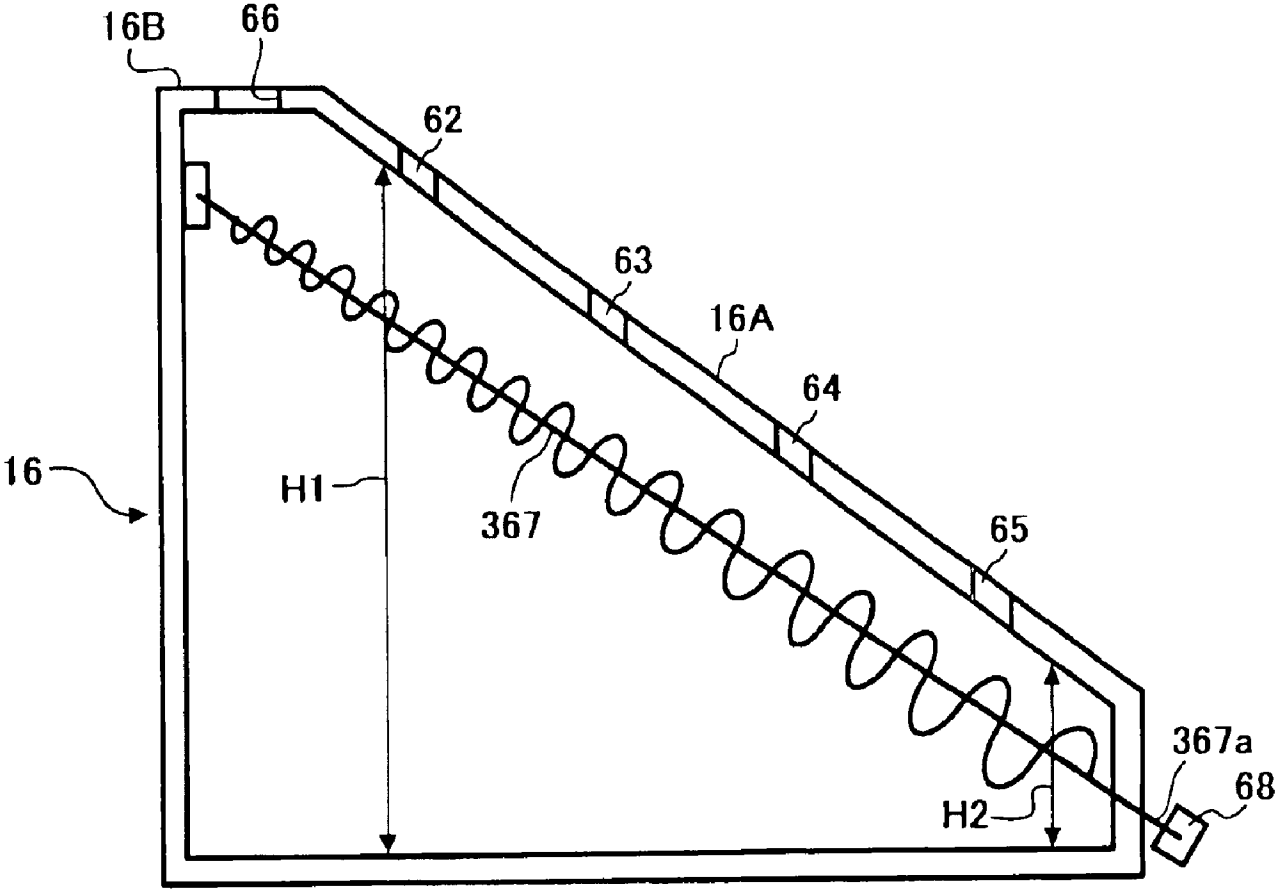
FIG. 11 is a cross sectional view of yet another embodiment of the waste toner collecting container of the present invention including a waste toner transporter having different transporting capacities in the feeding direction.

FIG. 11 illustrates another embodiment in which the waste toner transporter has a different transporting capacity in each portion of the container such that the transporting capacity is inversely proportional to a height of the portion. In the container 16 illustrated in FIG. 11, H1 represents a height of a portion having a long height (i.e., a portion on the side of the opening 62) and H2 (<H1) represents a height of a portion having a short height (i.e., a portion on the side of the opening 65).

In this case, the portion having a height H2 is fully filled with the waste toner more quickly than the portion having a height H1. Namely, the top of the mountain of the waste toner at the portion having a height H2 reaches more quickly than the portion having a height H1.

In the container 16 illustrated in FIG. 11, a portion of a screw member 367 near the opening 65 has a transporting capacity greater than that of a portion of the screw member 367 near the opening 62. The transporting capacity can be changed by the changing diameter or pitch of the screw. By providing such a screw member 367, having a lower end portion 367*a*, the waste toner piled on a portion having a short height (or a portion on which waste toner tends to be quickly piled) can be transported in a larger amount than that for other portions. Therefore, even when the container 16 has a special form, occurrence of problems such that the waste toner leaks from the opening 65 or the feeding pipe 61K is clogged with the waste toner and the piled toner and the piled waste toner is firmly fixed in the container can be prevented. Thus it is possible to make good use of the internal space of the container, and thereby the replace cycle of the container 16 can be extended, resulting in reduction of maintenance time and costs.

Figure 12:
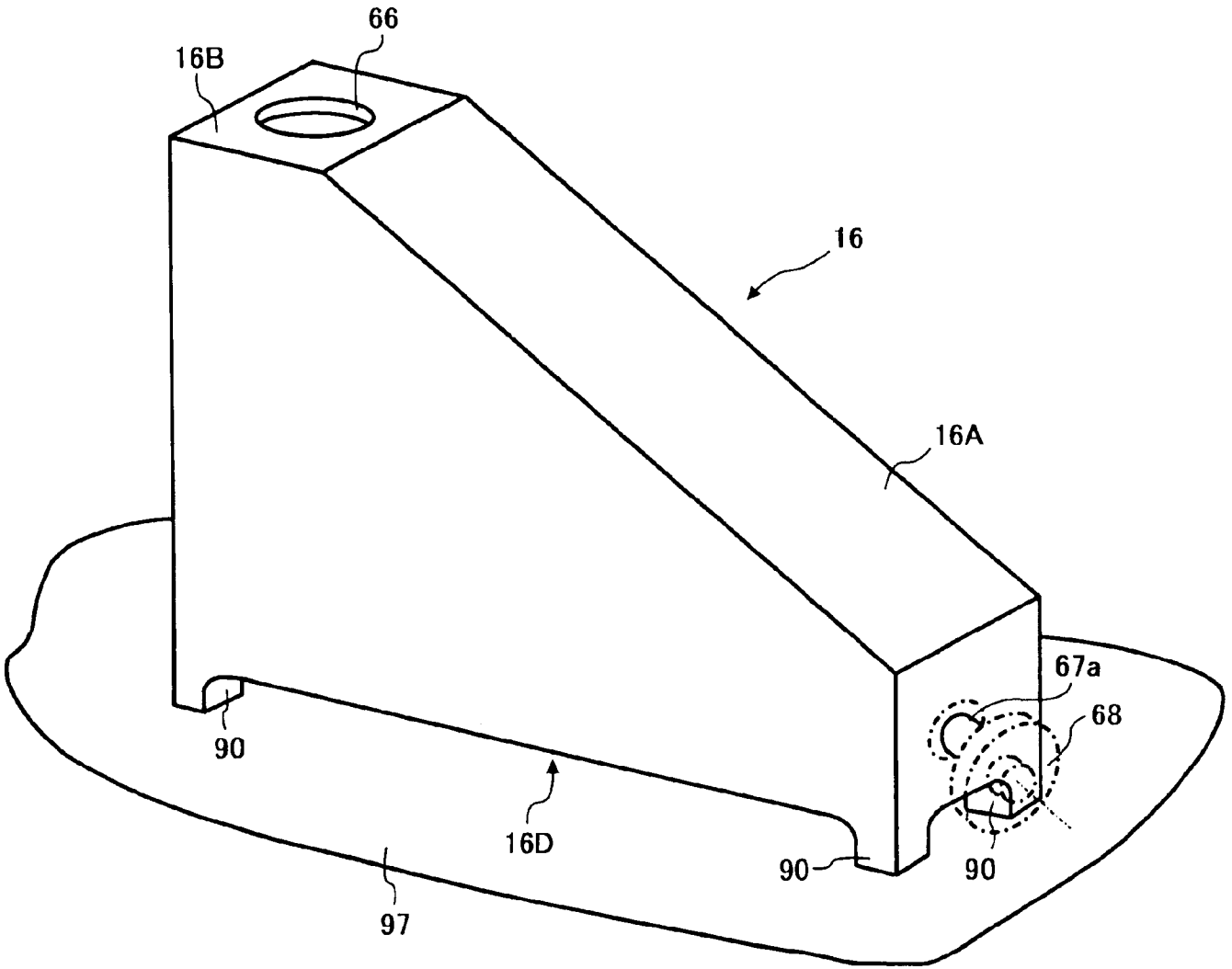
FIG. 12 is a cross sectional view of yet another embodiment of the waste toner collecting device of the present invention which can be securely set.

FIG. 12 illustrates another embodiment of the container 16 which can be stably fixed on a plane 97. In this embodiment plural legs 90 are provided on a bottom surface 16D of the container 16. Therefore, the bottom surface does not contacted with the plane 97. The legs 90 are preferably provided at the four corners of the container 16, but the container 16 can be supported by three legs, two of which are provided below the portion having a short height and the other of which is provided below the portion having a long height, and vice versa.

When the container 16 has such a constitution, the container 16 can be stably set on a plane while the container can be easy to handle when replaced.

Figure 13:
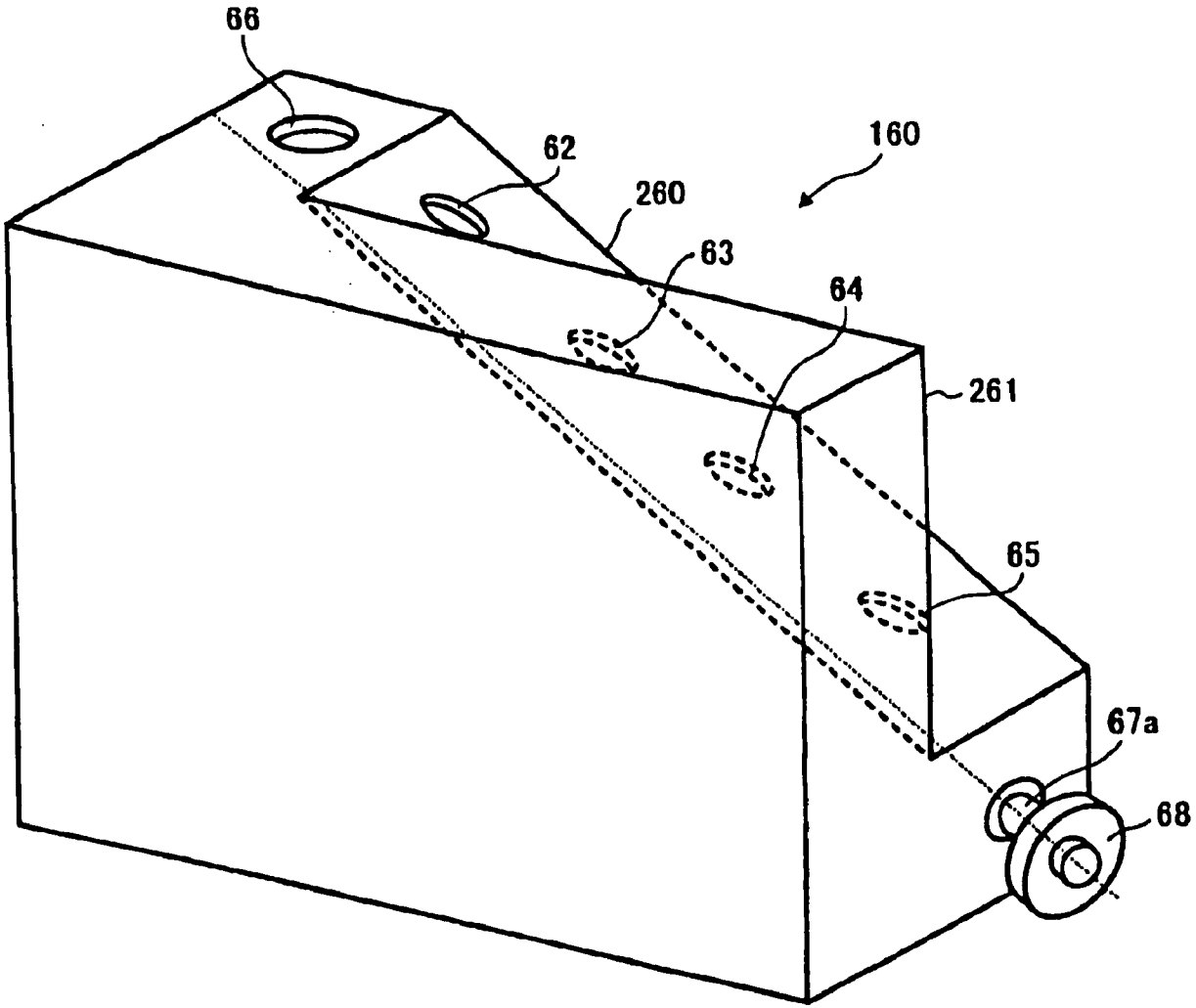
FIG. 13 is a cross sectional view of yet another embodiment of the waste toner collecting device of the present invention which includes a portion having no slanted portion.

FIG. 13 illustrates another container 160 which includes a portion 260 having the slanted surface 260A and a portion 261 having a rectangular form. The portions 260 and 261 are connected with each other so as to have one space therein.

By using such a container 160, a large amount of waste toner can be contained therein. Therefore, even when the container 160 has a special form, occurrence of problems such that the waste toner leaks from the opening 65 or the feeding pipe 61K is clogged with the waste toner and the piled waste toner is firmly fixed in the container can be prevented. Thus, it is possible to make good use of the internal space of the container 160, and thereby the replace cycle of the container 160 can be extended, resulting in reduction of maintenance time and costs.

Figure 14:
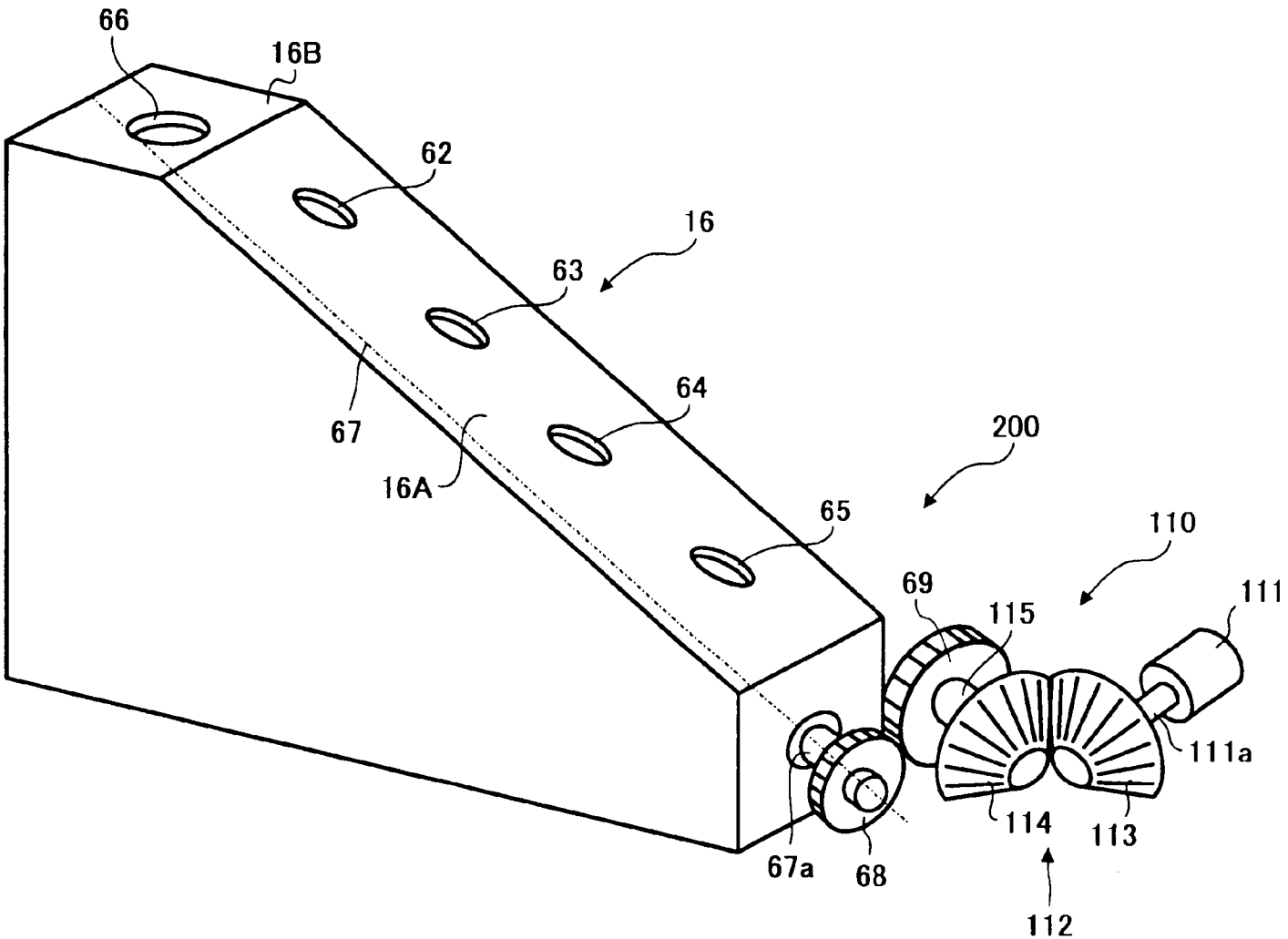
FIG. 14 is a perspective view illustrating an embodiment of the waste toner transport device for use in the present invention.
Figure 15:
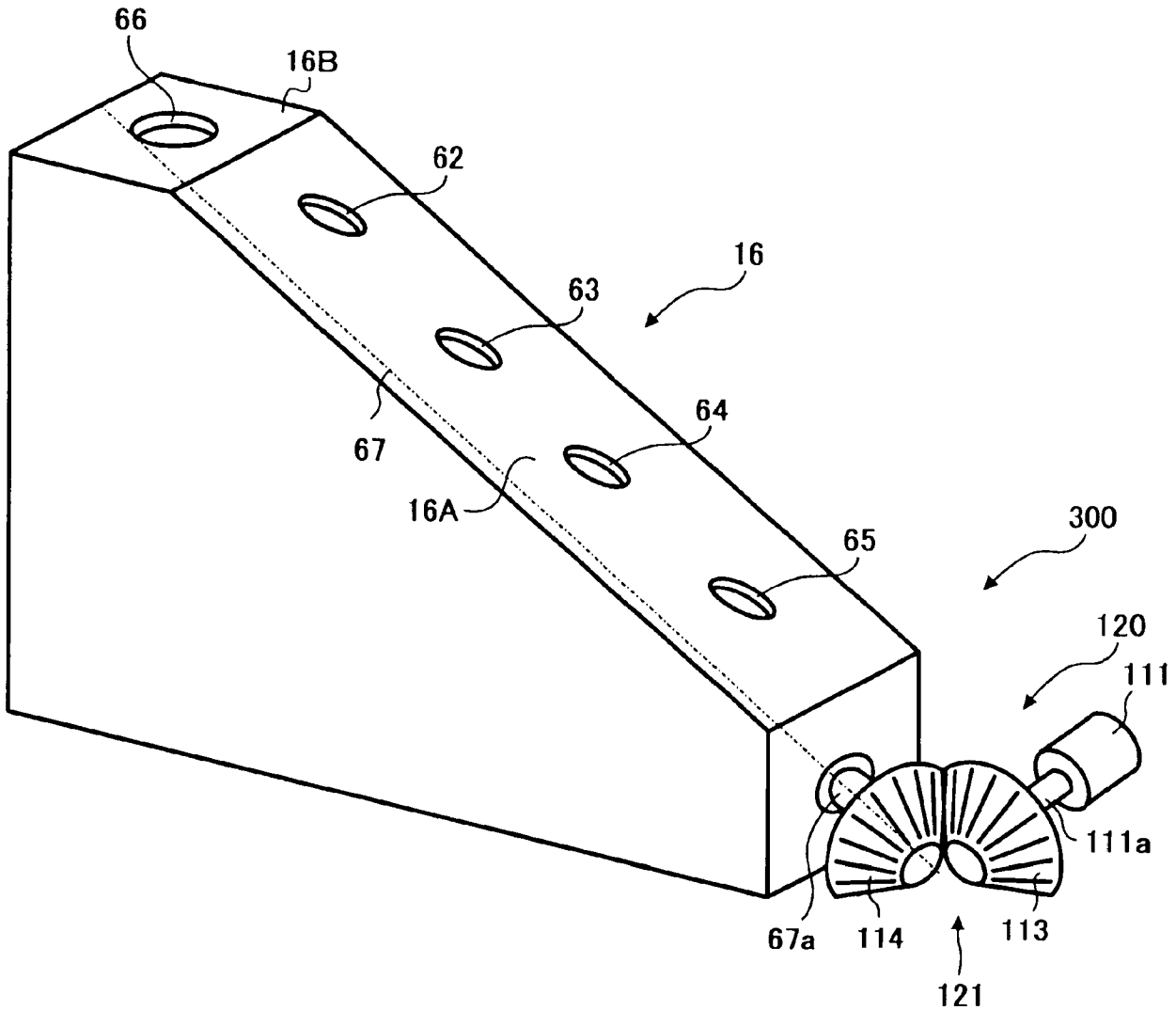
FIG. 15 is a perspective view illustrating another embodiment of the waste toner transport device for use in the present invention.

FIGS. 14 and 15 illustrate embodiments of the waste toner transporting device for use in the present invention. The waste toner transporting device 200 illustrated in FIG. 14 has a waste toner transporter and a driving device 110. The waste toner transporting device 300 illustrated in FIG. 15 has a waste toner transporter and a driving device 120. In this case, the screw member 67 is used as the waste toner transporter but the waste toner transporter is not limited thereto and may be a belt member or the like.

Referring to FIG. 14, the driving device 110 has a driving motor 111 and a drive force transmitting device 112 which transmits a driving force to the screw member 67. The drive force transmitting device 112 includes a spur gear 68 provided on the end 67*a* of the screw member 67 and a group of gears which transmits the driving force from the motor 111 to the spur gear 68.

The group of gears includes a gear 69 which is provided at an end of a shaft 115 arranged so as to be parallel to the screw member 67; a bevel gear 114 which is provided on the other end of the shaft 115; and a bevel gear 113 provided on a driving shaft of the motor 111. The spur gear 69 is engaged with the spur gear 68 and the bevel gear 114 is engaged with the bevel gear 113. The spur gear 69, bevel gears 113 and 114, and the driving motor 111 are arranged inside the main body 100 in FIG. 3. Referring to FIG. 3, when the container 16 is set in the main body in a direction indicated by the arrow C, the spur gear 68 is engaged with the spur gear 69.

In the driving device 110 having such a constitution, when the motor 111 rotates and a shaft 111*a* thereof rotates, the driving force is transmitted to the screw member 67 via the group of gears 113, 114, 69 and 68, and thereby the screw member 67 can be rotated.

Referring to FIG. 15, the driving device 120 has the driving motor 111 and a drive force transmitting device 121 which transmits a driving force of the motor 111 to the screw member 67. The drive force transmitting device 111 includes the bevel gear 114 provided on the end 67*a* of the screw member 67 and the bevel gear 113 which transmits the driving force of the motor 111 to the bevel gear 114.

The bevel gear 113 is provided on the shaft 111*a* of the motor 111, and the driving motor 111 and the bevel gear 113 are provided inside the main body 100 in FIG. 3. Referring to FIG. 3, when the container 16 is set in the main body in a direction indicated by the arrow C, the bevel gear 114 is engaged with the bevel gear 113.

In the drive force transmitting device 120 having such a constitution, when the motor 111 rotates and the shaft 111*a* thereof rotates, the driving force is transmitted to the screw member 67 via the bevel gears 113 and 114, and thereby the screw member 67 can be rotated.

By using bevel gears or spur gears for the drive force transmitting devices 112 and 121, the loss in transmitting a driving force is relatively small, and in addition replacement of the container 16 can be relatively easily performed compared to a case in which a belt or a pulley is used.

This document claims priority and contains subject matter related to Japanese Patent Application No. 2002-266886, filed on Sep. 12, 2002, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A waste toner collecting device comprising:

a container being detachably set in an image forming apparatus, containing therein a waste toner produced in the image forming apparatus, and having a shape configured to fit into a free space of the image forming apparatus; and a waste toner transport device configured to transport the waste toner in the container, wherein the waste toner transport device transports the waste toner in the container in a direction from a region of the container having a shortest height toward a region thereof having a tallest height.

2. The waste toner collecting device according to claim 1, wherein a surface of the container is opposed to a surface of a member of the image forming apparatus.

3. The waste toner collecting device according to claim 2, wherein the member is a slantedly arranged cleaning unit comprising a plurality of cleaners and a surface of the container is slanted in a same direction as that of the slantedly arranged cleaning unit.

4. The waste toner collecting device according to claim 3, wherein the surface of the container is slanted at substantially a same angle as that of the slantedly arranged cleaning unit.

5. The waste toner collecting device according to claim 3, wherein the container further comprises at least one opening connected with the cleaning unit via at least one waste toner feeding passage of the image forming apparatus.

6. The waste toner collecting device according to claim 5, wherein the at least one opening is located at a highest position of the container.

7. The waste toner collecting device according to claim 5, wherein the container has plurality of openings arranged at regular intervals.

8. The waste toner collecting device according to claim 5, wherein the at least one opening is arranged on the slanted surface or a side surface of the container.

9. The waste toner collecting device according to claim 5, wherein the at least one opening has an area greater than an area of a cross section of the at least one waste toner feeding passage.

10. The waste toner collecting device according to claim 3, wherein the waste toner transport device comprises:

at least one waste toner transporter arranged in the container to transport the waste toner in the container; and a driving device configured to drive the waste toner transporter.

11. The waste toner collecting device according to claim 10, wherein the at least one waste toner transporter is configured to transport the waste toner in such a direction that the waste toner is distanced from at least one opening.

12. The waste toner collecting device according to claim 10, wherein the waste toner transport device includes plurality of waste toner transporters in the container.

13. The waste toner collecting device according to claim 10, wherein the at least one waste toner transporter comprises at least one of a screw, a plurality of screws, a partially threaded screw, and a belt.

14. The waste toner collecting device according to claim 13, wherein the at least one waste toner transporter is located below at least one opening.

15. The waste toner collecting device according to claim 10, wherein the driving device comprises:

a driving motor; and a drive force transmitting device configured to transmit a driving force of the driving motor to the at least one waste toner transporter.

16. The waste toner collecting device according to claim 15, wherein the drive force transmitting device comprises either a group of gears comprising a spur gear or another group of gears including a bevel gear, and wherein the spur gear or the bevel gear is provided on an end of the at least one waste toner transporter.

17. The waste toner collecting device according to claim 3, wherein the container comprises a waste toner containing a portion that does not have a slanted surface.

18. The waste toner collecting device according to claim 1, wherein the container comprises a support member on a bottom surface thereof.

19. An image forming apparatus, comprising:

an image bearing member;

a cleaning device configured to collect a residual toner present on the image bearing member; and the waste toner collecting device according to claim 1.

20. A waste toner collecting device comprising:

a container being detachably set in an image forming apparatus, containing therein a waste toner produced in the image forming apparatus, and having a shape configured to fit into a free space of the image forming apparatus; and a waste toner transport device configured to transport the waste toner in the container, wherein the waste toner transport device has a different transporting capacity in each portion of the container such that the transporting capacity is inversely proportional to a height of the portion of the container.

21. An image forming apparatus comprising:

an image bearing member;

a cleaning device configured to collect a residual toner present on the image bearing member; and the waste toner collecting device according to claim 20.

22. A waste toner collecting device, comprising:

a container being detachably set in an image forming apparatus, and having a shape configured to fit into a free space of the image forming apparatus, the container comprising a slanted surface with an opening for the passage of waste toner and a substantially vertical surface; and a waste toner transport device configured to transport the waste toner in the container in a direction from a region of the container having a tallest height toward a region thereof having a shortest height, wherein the opening is located in a region where the slanted surface meets the substantially vertical surface, the region defining the tallest height of the container.

23. The waste toner collecting device according to claim 22, wherein a surface of the container is opposed to a surface of a member of the image forming apparatus.

24. The waste toner collecting device according to claim 23, wherein the member is a slantedly arranged cleaning unit comprising a cleaner, and a surface of the container is slanted in a same direction as that of the slantedly arranged cleaning unit.

25. The waste toner collecting device according to claim 24, wherein the surface of the container is slanted at substantially a same angle as that of the slantedly arranged cleaning unit.

26. The waste toner collecting device according to claim 24, wherein the slantedly arranged cleaning unit comprises a plurality of cleaners, and the container has a plurality of openings arranged at regular intervals.

27. The waste toner collecting device according to claim 26, wherein at least one opening of the plurality of openings is arranged on the slanted surface or a side surface of the container.

28. The waste toner collecting device according to claim 26, wherein at least one opening of the plurality of openings has an area greater than an area of a cross section of a feeding passage connecting at least one opening of the plurality of openings and the slantedly arranged cleaning unit.

29. The waste toner collecting device according to claim 24, wherein the waste toner transport device comprises:

at least one waste toner transporter arranged in the container to transport the waste toner in the container; and a driving device configured to drive the waste toner transporter.

30. The waste toner collecting device according to claim 29, wherein the at least one waste toner transporter is configured to transport the waste toner in such a direction that the waste toner is distanced from the opening.

31. The waste toner collecting device according to claim 29, wherein the waste toner transport device includes a plurality of waste toner transporters in the container.

32. The waste toner collecting device according to claim 29, wherein the at least one waste toner transporter comprises a screw.

33. The waste toner collecting device according to claim 32, wherein the at least one waste toner transporter comprises a plurality of screws.

34. The waste toner collecting device according to claim 29, wherein the at least one waste toner transporter comprises a partially threaded screw.

35. The waste toner collecting device according to claim 29, wherein the at least one waste toner transporter comprises a belt.

36. The waste toner collection device according to claim 35, wherein the at least one waste toner transporter is located below the opening.

37. The waste toner collecting device according to claim 29, wherein the driving device comprises:

a driving motor; and a drive force transmitting device configured to transmit a driving force of the driving motor to the at least one waste toner transporter.

38. The waste toner collecting device according to claim 37, wherein the drive force transmitting device comprises either a group of gears comprising a spur gear or another group of gears including a bevel gear, and wherein the spur gear or the bevel gear is provided on an end of the at least one waste toner transporter.

39. The waste toner collecting device according to claim 22, wherein the container comprises a support member on a bottom surface thereof.

40. The waste toner collecting device according to claim 22, wherein the container comprises a waste toner containing a portion that does not have a slanted surface.

41. An image forming apparatus, comprising:

an image bearing member;

a cleaning device configured to collect a residual toner present on the image bearing member; and the waste toner collecting device according to claim 22.

42. The waste toner collecting device according to claim 22, wherein the waste toner transport device has a different transporting capacity in each portion of the container such that the transporting capacity is inversely proportional to a height of the portion of the container.

* * * * *